US005328097A

United States Patent [19]

Wesch et al.

[11] Patent Number: 5,328,097

[45] Date of Patent: Jul. 12, 1994

[54] ROTOR NOZZLE FOR A HIGH-PRESSURE CLEANING DEVICE

[75] Inventors: Johann G. Wesch, Berglen; Gerhard Dellert, Backnang, both of Fed. Rep. of Germany

[73] Assignee: Alfred Karcher GmbH & Co., Winnenden, Fed. Rep. of Germany

[21] Appl. No.: 940,957

[22] PCT Filed: Apr. 15, 1991

[86] PCT No.: PCT/EP91/00714

§ 371 Date: Oct. 26, 1992

§ 102(e) Date: Oct. 26, 1992

[87] PCT Pub. No.: WO91/16989

PCT Pub. Date: Nov. 14, 1991

[30] Foreign Application Priority Data

Apr. 27, 1990 [DE] Fed. Rep. of Germany ..... 4013446

[51] Int. Cl.[5] ..... B05B 3/06; B05B 3/08

[52] U.S. Cl. ..... 239/243; 239/252; 239/261

[58] Field of Search ..... 239/237, 240, 251, 252, 239/256, 261, 381, 243, 245; 384/125

[56] References Cited

U.S. PATENT DOCUMENTS

| | | | |
|---|---|---|---|
| 2,854,283 | 9/1958 | Hruby, Jr. . | |
| 3,126,025 | 3/1964 | Aubert et al. . | |
| 4,073,438 | 2/1978 | Meyer | 239/237 |
| 4,747,544 | 5/1988 | Kränzle | 239/252 |
| 4,989,786 | 2/1991 | Kränzle et al. | 239/240 |

FOREIGN PATENT DOCUMENTS

| | | |
|---|---|---|
| 3150879 | 8/1982 | Fed. Rep. of Germany . |
| 0153129 | 8/1985 | Fed. Rep. of Germany . |
| 3419964 | 12/1985 | Fed. Rep. of Germany . |
| 3623368 | 9/1987 | Fed. Rep. of Germany . |
| 8909876 | 11/1989 | Fed. Rep. of Germany . |

*Primary Examiner*—Andres Kashnikow
*Assistant Examiner*—Lesley D. Morris
*Attorney, Agent, or Firm*—Barry R. Lipsitz

[57] ABSTRACT

In order to reduce the undesired rotation of the nozzle body about its own longitudinal axis in a rotor nozzle for a high-pressure cleaning device comprising a casing having in a front wall a pot-shaped recess with a central opening therein, a nozzle body with a bore extending through it, the nozzle body being supported at a spherical end in the pot-shaped recess, extending in the longitudinal direction over part of the casing and having an outside diameter which is smaller than the inside diameter of the casing, and an inlet for a liquid opening tangentially into the casing and causing the liquid to rotate about the longitudinal axis in the casing so that the nozzle body rotates together with the rotating liquid and when doing so bears with a bearing surface at its circumference on the inside wall of the casing with the longitudinal axis of the nozzle body at an incline to the longitudinal axis of the casing, it is proposed that the bearing surface of the nozzle body consist of a material with a coefficient of friction in relation to the material of the inside wall of the casing of >0.25.

12 Claims, 2 Drawing Sheets

ROTOR NOZZLE FOR A HIGH-PRESSURE CLEANING DEVICE

Figure 1:
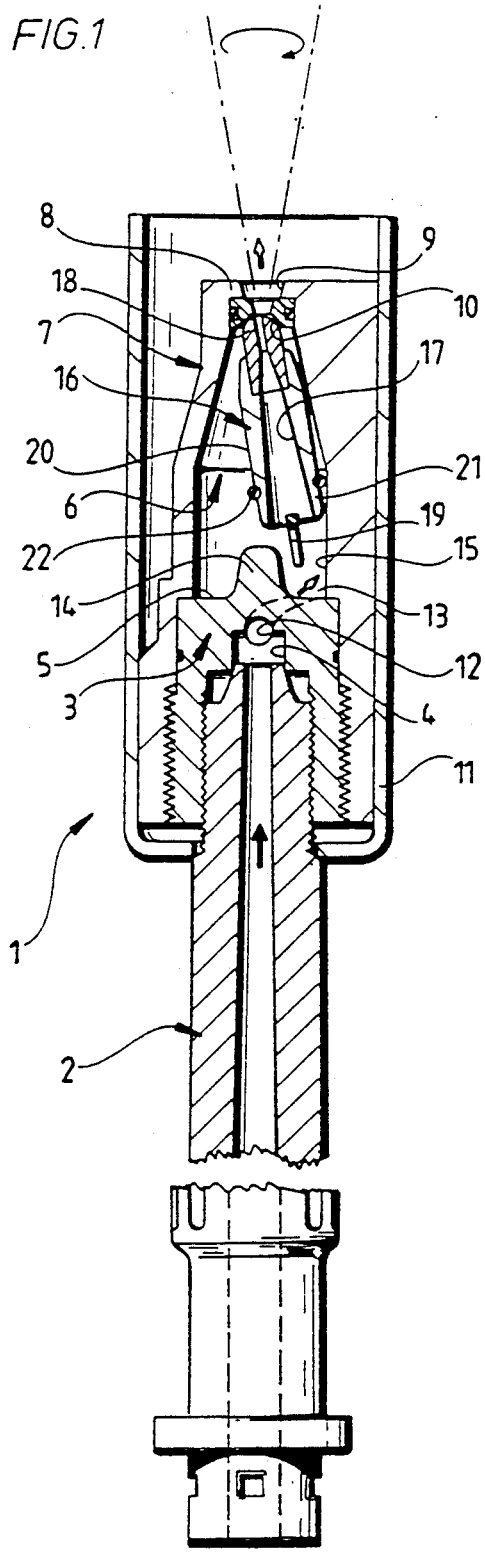

The invention relates to a rotor nozzle for a high-pressure cleaning device comprising a cylindrical casing having in a front wall a pot-shaped recess with a central opening therein, a nozzle body with a bore extending through it, the nozzle body being supported at a spherical end in the pot-shaped recess, extending in the longitudinal direction over part of the casing and having an outside diameter which is smaller than the inside diameter of the casing, and an inlet for a liquid opening tangentially into the casing and causing the liquid to rotate about the longitudinal axis in the casing so that the nozzle body rotates together with the rotating liquid and when doing so bears with a bearing surface at its circumference on the inside wall of the casing with the longitudinal axis of the nozzle body at an incline to the longitudinal axis of the casing.

In high-pressure cleaning devices and other spraying devices which produce a jet rotating on a conical area opening in the direction of the jet, various driving possibilities are known for generating such a moving jet in the rotor nozzle.

In a method which involves relatively high mechanical expenditure, provision is made for a rotor to be mounted in a casing for rotation about the longitudinal axis of the casing and to be driven by the jet of liquid entering the casing. A nozzle body mounted in the casing likewise for rotation about the longitudinal axis of the casing and at an incline to the longitudinal axis is driven via a gearing, for example, a toothed gearing (EP-A2-153129). Use of a toothed gearing involves considerable structural expenditure and also there is the danger that with continuous use, the meshing gear parts will only have a short working life as a result of wear.

It is also known to avoid the gearing in such a construction, in principle, by the rotor itself carrying a nozzle channel extending at an incline (German patent 34 19 964). This construction also requires mounting of the rotor on both sides, which may be susceptible to failure; also sealing problems may occur on the outlet side, in particular, when used in high-pressure cleaning devices.

For this reason, elongated pressing members mounted in pot-shaped recesses and driven by a rotor mounted in the casing about the longitudinal axis thereof are used in further known rotor nozzles (German patent 36 23 368). In this construction, sealing problems are avoided in the outlet area, but the expenditure involved is still relatively high as a rotatable rotor has to be provided in addition to the nozzle body mounted in a pot-shaped recess.

In a construction known from German utility model 89 09 876, a rotor mounted for rotation about the longitudinal axis of the casing is avoided by rotor blades being formed on the nozzle body itself and a jet of liquid which leads centrally and axially into the casing striking these. The nozzle body rolls off the inside surface of the casing under the influence of this central jet and when doing so the outer circumference of the nozzle body which is provided with a toothed rim preferably meshes with a toothed rim on the inside wall of the casing. This construction is also relatively elaborate owing to the necessity for the rotor blades and the toothed rims.

A structurally simple and yet properly functioning rotor nozzle is known from German published patent application 31 50 879. In this construction a nozzle body provided in a pot-shaped support in the casing is made to rotate on a conical area by being taken along by a column of liquid rotating about the longitudinal axis in the interior of the casing. The column of liquid is made to rotate about the longitudinal axis by the liquid being introduced tangentially into the interior of the casing. However, difficulties arise in this construction when this rotor nozzle is to be supplied with liquid under high pressure. For, the column of liquid rotating about the longitudinal axis acts in particular in the front region of the nozzle body in which the latter is mounted in the central, pot-shaped recess as rotary drive for the nozzle body so that a strong inherent rotation is imparted to the latter about its own longitudinal axis. This inherent rotation about the longitudinal axis superimposes itself with the movement of the nozzle body on the conical area, and this inherent rotation results in the jet which issues from the nozzle body also being made to rotate about its longitudinal axis. Once the liquid particles accelerated accordingly in the circumferential direction leave the nozzle body, the jet, therefore, fans out to a very great extent and so the cleaning effect already decreases at a short distance from the nozzle body.

The object of the invention is to provide a generic rotor nozzle design in which this undesired inherent rotation of the nozzle body is reduced so that the compactness of the issued jet can thereby be increased.

This object is accomplished in accordance with the invention in a rotor nozzle of the kind described at the beginning by the bearing surface of the nozzle body consisting of a material with a coefficient of friction in relation to the material of the inside wall of the casing of $>0.25$, in particular, $>0.5$.

The increased friction between the nozzle body and the inside wall of the casing in the region of the bearing surface results in the nozzle body being at least partly rolled off the inside wall. This rolling-off movement results in a rotation of the nozzle body about its own axis, but the direction of rotation is opposite to the direction of rotation which the rotating column of liquid forces upon the nozzle body in the casing interior. Therefore, owing to the increased friction the inherent rotation of the nozzle body forced upon it by the rotating column of liquid is counteracted and in this way its undesired inherent rotation is substantially eliminated.

The nozzle body can be made entirely from an appropriate material, for example, an elastomeric plastic material.

However, the nozzle body is preferably coated in the region of the bearing surface with a material having a coefficient of friction in relation to the material of the inside wall of the casing of $>0.25$ and, in particular, $>0.5$; the inside wall of the casing may, of course, also have a corresponding coating.

This coating may have the shape of an O-ring inserted in a circumferential groove of the nozzle body or a circumferential groove of the casing and consisting of an elastomeric material with the required friction values. This solution has the additional advantage that when the region of the bearing surface is worn, the O-ring forming the bearing surface can be easily exchanged.

In a preferred embodiment, provision is made for brake elements protruding radially from the inside wall of the casing to be arranged in the region of the pot-shaped recess. These are preferably walls which are arranged in radial planes of the casing and surround the area of movement of the nozzle body. Such brake elements counteract the rotational movement of the liquid about the longitudinal axis of the casing in the region near the outlet, and it is precisely in this region that the rotation of the column of liquid results in the undesired inherent rotation of the nozzle body. These brake elements, therefore, also have the effect of reducing the undesired stimulation of the inherent rotation of the nozzle body. This measure is particularly advantageous in combination with the increase of the coefficient of friction in the bearing region as both effects act in the same direction, but these brake elements can also develop the previously mentioned effect by themselves, i.e., without an increase in the friction in the bearing region.

It is very advantageous for the inlet to be arranged on the side facing away from the pot-shaped recess of the casing in a region of the casing into which the nozzle body supported by the pot-shaped recess does not reach. If an inlet opens into the casing in a region in which the nozzle body is located, this incoming flow can also promote the inherent rotation of the nozzle body. By separating the liquid inlet and the nozzle body from one another spatially, this undesired stimulation of the inherent rotation of the nozzle body is substantially avoided. The tangential inlet can be arranged in both the jacket and the bottom of the casing; in this connection it is essential that the incoming liquid should not directly strike the side wall of the nozzle body at a tangent thereto.

The length of the nozzle body is preferably $>\frac{3}{4}$ of the length of the casing; with shorter nozzle bodies there is the danger that the nozzle bodies will start to vibrate and generate an unsmooth, fanned-out jet.

In a preferred embodiment, provision is made for the end wall of the casing opposite the pot-shaped recess to have a central projection protruding into the casing interior and forming in the casing interior an annular space into which the end of the nozzle body facing away from the spherical end dips when it is supported with its spherical end in the pot-shaped recess. Such an annular space with the tangential inlet opening into it generates a rotation of the column of liquid in the casing interior, with the liquid particles preferably residing in the region near the walls. This reduces the probability of transfer of an inherent rotation at the outlet end at which the nozzle body is centrally mounted. Also this arrangement of the projection already provides a preorientation of the nozzle body before the start of a flow of liquid so that on switching on the flow of liquid, the nozzle body already assumes an inclined position and is thereby reliably pressed against the inside wall of the casing once the liquid flows through the casing.

It is advantageous for the nozzle body to have a smaller outside diameter at the end dipping into the annular space than on the remaining part of its overall length; for example, the nozzle body can carry on its end opposite the spherical end only a central extension pin which protrudes into the annular space.

In a further preferred embodiment, a second inlet for liquid opens into the casing parallel to the longitudinal axis, and a distributor is provided for selectively feeding the liquid to one or the other inlet or to both inlets simultaneously. In the case of entry through the tangential inlet, the nozzle body is made to rotate along the conical area, but in the case of entry through the axial inlet it is not. By appropriate distribution, the rotational speed at which the nozzle body rotates on the conical area can thus be varied.

In a further preferred embodiment, provision is made for a further nozzle body communicating with a supply of liquid which also leads to the inlet or inlets of the casing to be stationarily arranged beside the casing, and for a switching-over to selectively release or close the flow path to the stationary nozzle body. In this way the user can choose whether he wants to generate a rotary jet or a stationary jet.

It is particularly advantageous for adjustable supporting surfaces on which the nozzle body bears with its bearing surface to be provided in the interior of the casing, and for the angle of inclination of the longitudinal axis of the nozzle body relative to the longitudinal axis of the casing to be different in different positions of the supporting surfaces. Merely by displacing the supporting surfaces, it is, therefore, possible to vary the apex angle of the rotating point jet.

Figure 2:
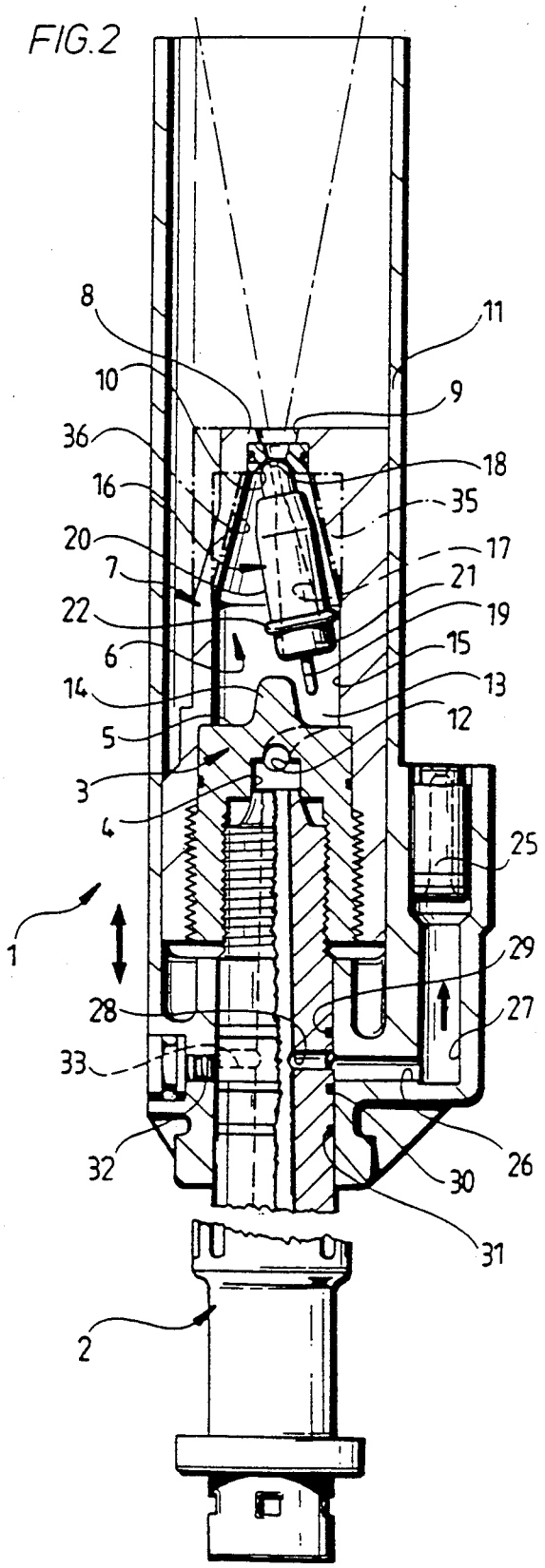
Figure 3:
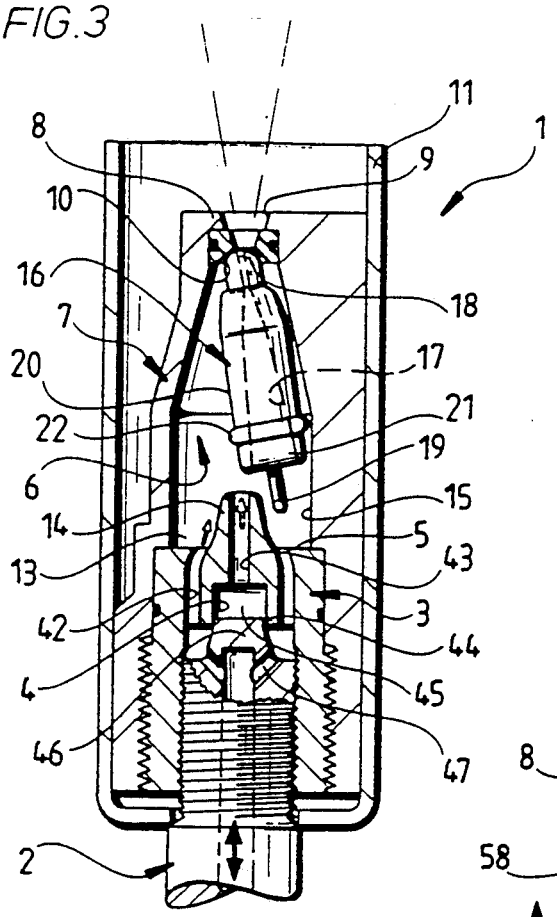
Figure 4:
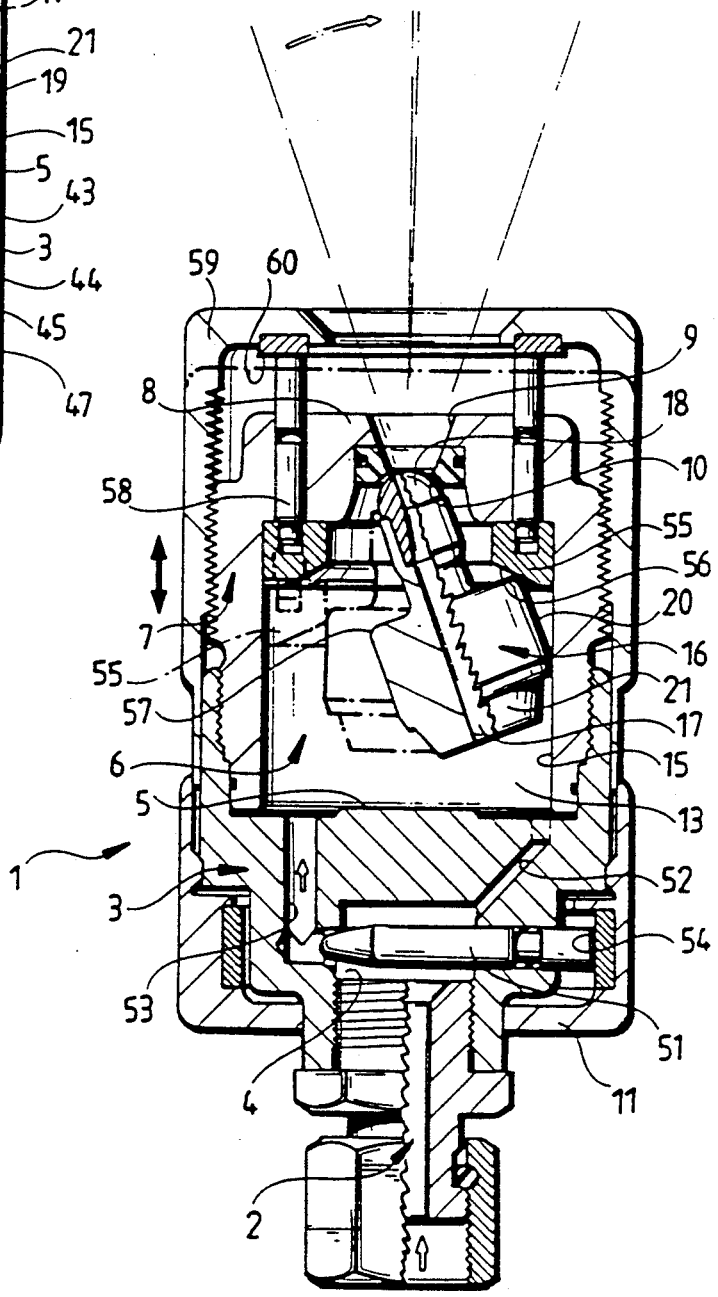

The following description of preferred embodiments serves in conjunction with the drawings to explain the invention in further detail. The drawings show:

FIG. 1 a longitudinal sectional view of a rotor nozzle with a nozzle body rotating around a conical area;

FIG. 2 a longitudinal sectional view of a further preferred embodiment of a rotor nozzle with additional switchover to a stationary nozzle body;

FIG. 3 a longitudinal sectional view of a further preferred embodiment of a rotor nozzle with rotational speed variation of the nozzle body; and FIG. 4 a longitudinal sectional view of a further preferred embodiment of a rotor nozzle with adjustment of the apex angle of the nozzle body.

The rotor nozzle 1 illustrated in FIG. 1 is screwed onto the jet pipe 2 of a high-pressure cleaning device which is not illustrated in the drawings. This jet pipe is connectable by means of a flexible high-pressure line to the delivery side of a high-pressure pump and then supplies a cleaning liquid which may have chemicals added to it under high pressure, for example, at 100 bar.

A hood-shaped bottom part 3 with an interior 4 which narrows in step-shaped configuration and has the jet pipe 2 leading into the end portion thereof is screwed onto the end of the jet pipe 2.

The bottom part 3 forms the bottom 5 of a cylindrical interior 6 of a casing 7 which is screwed onto the bottom part 3 and the interior 6 of which tapers conically towards the front wall 8 opposite the bottom 5. The front wall 8 contains a central opening 9 which is surrounded by a pot-shaped recess 10, i.e., a shoulder of arcuate cross-section surrounding the opening 9 in ring-shaped configuration on the inside of the casing 7.

The casing 7 is covered by a hood 11 which is open towards the front and extends so far towards the free end of the casing 7 that it protrudes over the front wall 8.

From the lowermost part of the interior 4 channels 12 enter the bottom part 3 in the radial direction and lead into the interior 6 with a component extending tangentially in the circumferential direction. There they enter an annular space 13 which is adjacent to the bottom 5 and is formed between a central projection 14 protruding into the interior 6 and the inside wall 15 of the interior 6.

Arranged inside the interior is an essentially tube-shaped nozzle body 16 which has an opening 17 extending through it in the longitudinal direction and is of spherical design at its end facing the front wall 8. This spherical end 18 dips into the pot-shaped recess 10 and is supported in it. At its opposite end, the nozzle body 16 carries a central, pin-shaped extension 19 which dips into the annular space 13. On the outside wall 20 of the nozzle body 16, an O-ring 22 made of elastomeric material is inserted in a circumferential groove, not clearly visible in the drawings, at the end 21 opposite the spherical end 18. When the nozzle body is in a corresponding inclined position, the O-ring bears on the inside wall 15 of the interior 6. The O-ring consists of an elastomeric material with a coefficient of friction in relation to the material of the inside wall 15 which is relatively high, for example, >0.25 and, in particular, >0.5.

During operation, liquid is introduced under high pressure via the jet pipe 2 into the interior 4 and from there travels via the channels 12 into the interior 6. Owing to the corresponding configuration of the channels 12, the liquid enters the interior 6 at a tangent to the circumferential direction and so a column of liquid rotating about the longitudinal axis is formed within the interior 6. As it rotates about the longitudinal axis, this column of liquid also takes the nozzle body 16 along with it. The nozzle body thus rotates along a conical area, with the apex angle being determined by the bearing of the O-ring 22 on the inside wall 15 of the interior 6.

In the region close to the recess 10, the column of liquid rotating about the longitudinal axis of the casing 7 attempts to force a rotation in the same direction on the nozzle body 16, but in the region of the O-ring 22 a driving torque in the opposite direction is imparted to the nozzle body by the rolling-off movement on the inside wall 15 of the interior 6, and the two opposed tendencies neutralize one another to a substantial degree. As a result of this, during its movement around the conical area the nozzle body 16 executes only a very slight rotation about its own axis so that essentially an acceleration in the longitudinal direction of the nozzle body 16, but not a rotary acceleration about the longitudinal axis of the nozzle body 16 is imparted to liquid entering through the through-opening 17. The issuing jet of liquid, therefore, remains compact over quite a large distance and does not fan out as a result of high inherent rotation.

The embodiment illustrated in FIG. 2 is similar in design to that of FIG. 1; corresponding parts, therefore, bear the same reference numerals.

The rotor nozzle of FIG. 2 additionally carries a stationary nozzle body 25 which is formed in the hood 11 and is held on the hood 11 in laterally offset relation to the casing 7. Located in the jet pipe 2 is a radial bore 28 which emerges from the jet pipe 2 between two circumferential seals 29 and 30 inserted in the jet pipe 2. A third circumferential seal 31 is arranged upstream from the two circumferential seals 29 and 30.

In contrast with the embodiment of FIG. 1, the hood 11 in the embodiment of FIG. 2 is displaceable in the axial direction in relation to the casing 7 so that a radially extending connection line 26 arranged in the hood 11 and leading via an axial connection line 27 to the stationary nozzle body 25 can be selectively arranged between the circumferential seals 29 and 30 or between the circumferential seals 30 and 31. In the first case, a connection is established with the radial bore 28 so that a flow path to the stationary nozzle body 25 is created via this radial bore 28 and the two connection lines 26 and 27. In the other case, the connection line 26 ends abruptly on the outer jacket of the jet pipe 2, while the bore 28 is sealed by the two adjacent circumferential seals 29 and 30 from the hood 11 covering it.

In order to fix the hood 11 in the position in which the connection line 26 is in alignment with the bore 28, there is additionally located in the hood 11 a spring-loaded detent ball 32 which can dip into an opening 33 in the jet pipe 2 and thus makes displacement of the hood 11 relative to the casing 7 possible only when a certain force is exceeded.

With this embodiment the user has the possibility of choosing between delivery of a rotating point jet rotating around a conical area and delivery of a stationary jet by displacing the hood 11 relative to the casing 7. When the connection line 26 and the radial bore 28 are in alignment with one another, the majority of the liquid travels solely to the nozzle body 25 as the flow resistance through the interior 6 is considerably greater than that during passage through the stationary nozzle body 25. If, on the other hand, the bore 28 is closed, the total amount of liquid passes in the manner described with reference to the embodiment of FIG. 1 through the interior 6 and generates therein a compact point jet which rotates on a conical area.

In the embodiment of FIG. 2, the interior 6 is of cylindrical design throughout its entire length. In the region located downstream, the interior additionally carries walls 35 which are arranged in radial planes and extend with their inside edge 36 inwardly at an incline in the direction of flow. These walls 35 form a whirl brake for the column of liquid rotating about the longitudinal axis in the interior, i.e., they brake the rotational movement of the column of liquid in this region near the outlet. As a result of this, less inherent rotation is transmitted to the nozzle body 16 in this region, i.e., the tendency towards undesired inherent rotation of the nozzle body about its longitudinal axis is reduced by this measure. This measure is particularly advantageous in combination with the driving force generated by the rolling-off movement of the nozzle body which counteracts the undesired inherent rotation and is promoted by the increased coefficient of friction of the contacting material, but in all of the embodiments this measure can also be employed alone to suppress the undesired inherent rotation of the nozzle body 16 about its longitudinal axis.

In the illustrated embodiment walls extending in radial planes are used as whirl brake; other projections protruding into the interior could also be used for this so that in the region of the interior near the outlet, the interior exhibits alternately a large and a small internal diameter. It is essential that the rotation of the column of liquid in the interior only be reduced in the region near the outlet as this rotation is necessary in the region remote from the outlet in order to take along the nozzle body and allow it to rotate on the conical area.

The embodiment illustrated in FIG. 3 again corresponds substantially to that of FIG. 1; here, too, corresponding parts, therefore, bear the same reference numerals. The embodiment of FIG. 3 differs from that of FIG. 1 essentially in that both such channels 42 opening in the circumferential direction tangentially into the interior 6 and such channel 43 opening in the axial direction into the interior 6 issue from the interior 4 of the bottom part 3. The channels 42 issue from the interior 4 in the outer circumferential region thereof, more particularly, upstream from a step 44 which divides the upstream part of the interior 4 of larger diameter from the downstream part 45 of smaller diameter. The channel 43 entering the interior 6 axially issues from this part 45.

In this embodiment, the jet pipe 2 is closed at its end face on which it has a central projection 46 which is sealing placed against the step 44 so that the projection 46 separates the upstream part 45 of the interior 4 from the rest of the interior.

The interior of the jet pipe 2 communicates with the part of the interior 4 arranged upstream from the step 44 via bores 47 which extend outwardly at an incline. In this position of the jet pipe 2, the liquid introduced via the jet pipe 2 travels via the channels 42 opening in the circumferential direction into the interior 6 into the latter so that there is formed in the described manner in the interior 6 a column of liquid rotating about its longitudinal axis which takes the nozzle body 16 along with it and thus forms a compact jet rotating on a conical area.

The jet pipe 2 is displaceable in the axial direction relative to the bottom part 3 by being screwed out of the bottom part 3. The projection 46 then lifts off the step 44 and thus establishes a connection with the part 45 of the interior 4 via an annular gap formed between the step 44 and the projection 46. Liquid introduced via the jet pipe 2 can then additionally enter the interior via the axial channel 43 which does not generate any rotation of the column of liquid in the interior 6. A bypass is thus opened through which part of the liquid which has been introduced passes without contributing to the rotational movement of the compact jet along the conical area. The ratio of the distribution results, on the one hand, from the size of the axial displacement of the jet pipe 2 relative to the bottom part 3, i.e., by screwing the jet pipe 2 out of the bottom part 3 to a greater or lesser extent, and, on the other hand, from the flow cross-sections of the channels 42 and 43, respectively. If a large proportion of the liquid supplied enters the interior 6 via the channel 43, the rotation of the column of liquid in the interior 6 is weakened with the result that the rotational speed of the nozzle body 16 is reduced. The operator can in this way influence the rotational speed of the point jet which is generated.

The embodiment illustrated in FIG. 4 is also very similar to that of FIG. 1 and so here, too, corresponding parts bear the same reference numerals. As in the embodiment of FIG. 3, channels 52 which open tangentially to the circumferential direction into the interior 6 and channels 53 which open axially are provided in this embodiment. The channel 53 issues from the interior 4 in the radial direction. A needle valve body 51 extending transversely through the interior 4 rests sealingly in the region of the outlet and closes the channel 53 when it is pushed in completely but opens it when it is pulled out. The depth to which the needle valve body 51 dips in is determined by its bearing on an eccentric control track 54 which is located on the inside of the hood 11 arranged for rotation on the bottom part 3. In the illustrated embodiment this extends only over the height of the bottom part 3.

In this embodiment, the casing 7 is not screwed onto the bottom part 3 so as to engage over it but instead is screwed into it. In other respects, however, the design is similar for in this embodiment, too, a nozzle body 16 in the interior 6 rests with a spherical end 18 in the pot-shaped recess 10 and owing to the column of liquid rotating about the longitudinal axis in the interior 6 bears on the inside wall as it rotates along a conical area. There is no central projection 14 in the bottom part but instead the bottom 5 is of flat design.

A supporting ring 55 carrying a supporting surface 56 pointing inwardly at an incline is arranged at the downstream end in the interior 6. During its rotational movement along the conical area, the upper edge 57 of the nozzle body 16 bears on this supporting surface, and this bearing delimits the maximum inclined position of the nozzle body.

The supporting ring 55 is mounted for displacement in the axial direction in the interior 6. Push rods 58 extending through the front wall 8 are supported for this purpose on the ring 55 and rest with their outer end on a slide track 60 on the inside of a hood 59 engaging over the casing 7. The hood 59 is screwed onto the casing 7 and is thus movable by rotation in the axial direction relative to the casing 7. When the hood 59 is screwed further in, it pushes the push rods 58 into the interior 6 and thereby displaces the supporting ring 55 in the direction opposite to the direction of flow of the liquid. As a result of this, the nozzle body 16 rotating on a conical area already strikes the supporting surface 56 in a slightly inclined position, i.e., the apex angle of the point jet issued from the nozzle body 16 is decreased. The ring 55 can be displaced in this way until the nozzle body stands with its longitudinal axis parallel to the longitudinal axis of the casing; in this extreme case the nozzle then only delivers a centrally directed jet.

With the illustrated rotor nozzle, the user can control the ratio of the liquid which enters the interior 6 with a component in the circumferential direction or only in the axial direction by turning the hood 11 and thus the control track 54, i.e., the rotational speed of the nozzle body 16 can be regulated in the described manner. By turning the hood 59, the apex angle is adjustable. When the apex angle of the nozzle body 16 tends towards zero, it is advantageous to allow the flow to enter substantially through the axial channels 53 in order to avoid undesired rotation of the nozzle body and hence also undesired fanning-out of the compact jet.

Although it is not expressly described in the embodiment of FIG. 4, here, too, it is advantageous to increase the friction in the bearing region, i.e., in the region of the supporting surface 56 and the upper edge 57 by appropriate choice of the materials of the surfaces facing one another so that the undesired inherent rotation of the nozzle body is counteracted in the described manner.

We claim:

1. A rotor nozzle for a high-pressure cleaning device comprising:

a casing having a pot-shaped recess in a front wall thereof, said recess surrounding a central opening in said front wall;

a nozzle body having a bore extending therethrough, said nozzle body being supported at a spherical end thereof in said pot-shaped recess and extending in a longitudinal direction along a portion of said casing, an outside diameter of said nozzle body being smaller than an inside diameter of said casing and having a bearing surface thereon;

an inlet opening tangentially into said casing, for causing a liquid introduced into said casing therefrom to rotate about a longitudinal axis of the casing, thereby rotating said nozzle body with said bearing surface bearing on an inside wall of said casing with the longitudinal direction of said nozzle body being oriented at an incline with respect to the longitudinal axis of said casing;

a stationary nozzle body adjacent to said casing; and means for selectively coupling said liquid to said stationary nozzle;

wherein said bearing surface of said nozzle body consists of a friction material having a coefficient of friction that is >0.25 in relation to a material forming said inside wall of said casing.

2. A rotor nozzle for a high-pressure cleaning device comprising:

a casing having a pot-shaped recess in a front wall thereof, said recess surrounding a central opening in said front wall;

a nozzle body having a bore extending therethrough, said nozzle body being supported at a spherical end thereof in said pot-shaped recess and extending in a longitudinal direction along a portion of said casing, an outside diameter of said nozzle body being smaller than an inside diameter of said casing and having a bearing surface thereon;

an inlet opening tangentially into said casing, for causing a liquid introduced into said casing therefrom to rotate about a longitudinal axis of the casing, thereby rotating said nozzle body with said bearing surface bearing on an inside wall of said casing with the longitudinal direction of said nozzle body being oriented at an incline with respect to the longitudinal axis of said casing;

wherein:

said bearing surface of said nozzle body consists of a friction material having a coefficient of friction that is >0.25 in relation to a material forming said inside wall of said casing to counteract all but a very slight rotation of said nozzle body about its own axis, and said friction material comprises an elastomeric O-ring.

3. A rotor nozzle for a high-pressure cleaning device comprising:

a casing having a pot-shaped recess in a front wall thereof, said recess surrounding a central opening in said front wall;

a nozzle body having a bore extending therethrough, said nozzle body being supported at a spherical end thereof in said pot-shaped recess and extending in a longitudinal direction along a portion of said casing, an outside diameter of said nozzle body being smaller than an inside diameter of said casing and having a bearing surface thereon;

an inlet opening tangentially into said casing, for causing a liquid introduced into said casing therefrom to rotate about a longitudinal axis of the casing, thereby rotating said nozzle body with said bearing surface bearing on an inside wall of said casing with the longitudinal direction of said nozzle body being oriented at an incline with respect to the longitudinal axis of said casing;

wherein:

said bearing surface of said nozzle body consists of a friction material having a coefficient of friction that is >0.25 in relation to a material forming said inside wall of said casing;

a bottom wall of said casing opposite said pot-shaped recess carries a central projection protruding into an interior of said casing, said projection forming an annular space in said casing interior into which an end of said nozzle body opposite said spherical end projects when the nozzle body is supported with its spherical end in said pot-shaped recess; and the end of said nozzle body that projects into said annular space has a reduced diameter.

4. A rotor nozzle for a high-pressure cleaning device comprising:

a casing having in a front wall a pot-shaped recess with a central opening therein;

a nozzle body with a bore extending therethrough, said nozzle body being supported at a spherical end thereof in said pot-shaped recess and extending along a longitudinal axis thereof over part of the casing and having an outside diameter which is smaller than an inside diameter of the casing; and inlet means opening tangentially into the casing for causing a liquid introduced thereby to rotate about a longitudinal axis in the casing so that the nozzle body rotates together with the rotating liquid, said nozzle body having a bearing surface at its circumference that bears on an inside wall of the casing with the longitudinal axis of the nozzle body at an incline with respect to the longitudinal axis of the casing; and at least one brake element protruding radially from said inside wall of said casing, said brake element being arranged in a region of said pot-shaped recess.

5. A rotor nozzle as defined in claim 4, wherein said brake element comprises a wall which is arranged in a radial plane of said casing and surrounds the area of movement of said nozzle body.

6. A rotor nozzle for a high-pressure cleaning device comprising:

a casing having a pot-shaped recess in a front wall thereof, said recess surrounding a central opening in said front wall;

a nozzle body having a bore extending therethrough, said nozzle body being supported at a spherical end thereof in said pot-shaped recess and extending in a longitudinal direction along a portion of said casing, an outside diameter of said nozzle body being smaller than an inside diameter of said casing and having a bearing surface thereon;

an inlet opening tangentially into said casing, for causing a liquid introduced into said casing therefrom to rotate about a longitudinal axis of the casing, thereby rotating said nozzle body with said bearing surface bearing on an inside wall of said casing with the longitudinal direction of said nozzle body being oriented at an incline with respect to the longitudinal axis of said casing;

wherein said bearing surface of said nozzle body consists of a friction material having a coefficient of friction that is >0.25 in relation to a material forming said inside wall of said casing, said friction material being provided to counteract all but a very slight rotation of the nozzle body about its own axis which may be caused by rotation of said liquid about said longitudinal axis of the casing.

7. A rotor nozzle for a high-pressure cleaning device comprising:

a casing having a pot-shaped recess in a front wall thereof, said recess surrounding a central opening in said front wall;

a nozzle body having a bore extending therethrough, said nozzle body being supported at a spherical end thereof in said pot-shaped recess and extending in a longitudinal direction along a portion of said casing, an outside diameter of said nozzle body being smaller than an inside diameter of said casing and having a bearing surface thereon;

an inlet opening tangentially into said casing, for causing a liquid introduced into said casing therefrom to rotate about a longitudinal axis of the casing, thereby rotating said nozzle body with said bearing surface bearing on an inside wall of said casing with the longitudinal direction of said nozzle body being oriented at an incline with respect to the longitudinal axis of said casing;

a second inlet for introducing said liquid into said casing in parallel with said longitudinal axis of said casing; and distributor means for selectively providing said liquid to at least one of said inlets at a time;

wherein said bearing surface of said nozzle body consists of a friction material having a coefficient of friction that is >0.25 in relation to a material forming said inside wall of said casing.

8. A rotor nozzle for a high-pressure cleaning device comprising:

a casing having in a front wall a pot-shaped recess with a central opening therein;

a nozzle body with a bore extending therethrough, said nozzle body being supported at a spherical end thereof in said pot-shaped recess and extending along a longitudinal axis thereof over part of the casing and having an outside diameter which is smaller than an inside diameter of the casing; and inlet means opening tangentially into the casing for causing a liquid introduced thereby to rotate about a longitudinal axis in the casing so that the nozzle body rotates together with the rotating liquid, said nozzle body having a bearing surface at its circumference that bears on an inside wall of the casing with the longitudinal axis of the nozzle body at an incline with respect to the longitudinal axis of the casing;

a second inlet for liquid opening into and parallel to the longitudinal axis of said casing; and distributor means for selectively feeding liquid to one or the other of said inlets or to both inlets simultaneously.

9. A rotor nozzle for a high-pressure cleaning device comprising:

a casing having a pot-shaped recess in a front wall thereof, said recess surrounding a central opening in said front wall;

a nozzle body having a bore extending therethrough, said nozzle body being supported at a spherical end thereof in said pot-shaped recess and extending in a longitudinal direction along a portion of said casing, an outside diameter of said nozzle body being smaller than an inside diameter of said casing and having a bearing surface thereon;

an inlet opening tangentially into said casing, for causing a liquid introduced into said casing therefrom to rotate about a longitudinal axis of the casing, thereby rotating said nozzle body with said bearing surface bearing on an inside wall of said casing with the longitudinal direction of said nozzle body being oriented at an incline with respect to the longitudinal axis of said casing; and at least one brake element protruding radially from said inside wall of said casing adjacent said pot-shaped recess;

wherein said bearing surface of said nozzle body consists of a friction material having a coefficient of friction that is >0.25 in relation to a material forming said inside wall of said casing.

10. A rotor nozzle in accordance with claim 9 wherein said brake element comprises a wall arranged in a radial plane of said casing surrounding an area in which said nozzle body moves.

11. A rotor nozzle for a high-pressure cleaning device comprising:

a casing having in a front wall a pot-shaped recess with a central opening therein;

a nozzle body with a bore extending therethrough, said nozzle body being supported at a spherical end thereof in said pot-shaped recess and extending along a longitudinal axis thereof over part of the casing and having an outside diameter which is smaller than an inside diameter of the casing; and inlet means opening tangentially into the casing for causing a liquid introduced thereby to rotate about a longitudinal axis in the casing so that the nozzle body rotates together with the rotating liquid, said nozzle body having a bearing surface at its circumference that bears on an inside wall of the casing with the longitudinal axis of the nozzle body at an incline with respect to the longitudinal axis of the casing; and adjustable supporting surfaces in the interior of said casing on which the bearing surface of said nozzle body bears;

wherein the angle of inclination of said longitudinal axis of said nozzle body in relation to said longitudinal axis of said casing is different at different positions of said supporting surface.

12. A rotor nozzle for a high-pressure cleaning device comprising:

a casing having a pot-shaped recess in a front wall thereof, said recess surrounding a central opening in said front wall;

a nozzle body having a bore extending therethrough, said nozzle body being supported at a spherical end thereof in said pot-shaped recess and extending in a longitudinal direction along a portion of said casing, an outside diameter of said nozzle body being smaller than an inside diameter of said casing and having a bearing surface thereon;

an inlet opening tangentially into said casing, for causing a liquid introduced into said casing therefrom to rotate about a longitudinal axis of the casing, thereby rotating said nozzle body with said bearing surface bearing on an inside wall of said casing, with the longitudinal direction of said nozzle body being oriented at an incline with respect to the longitudinal axis of said casing, said inside wall comprising an adjustable support and said incline varying with the position of said adjustable support surface;

wherein said bearing surface of said nozzle body consists of a friction material having a coefficient of friction that is >0.25 in relation to a material forming said inside wall of said casing.

* * * * *